US005372286A

United States Patent [19]

King

[11] Patent Number: 5,372,286

[45] Date of Patent: Dec. 13, 1994

[54] SEALANT GUN

[76] Inventor: Peter King, 46, Brynfield Rd, Langland, Swansea, West Glamorgan, United Kingdom

[21] Appl. No.: 962,806

[22] PCT Filed: May 24, 1991

[86] PCT No.: PCT/GB91/00835

§ 371 Date: Dec. 21, 1992

§ 102(e) Date: Dec. 21, 1992

[87] PCT Pub. No.: WO91/18681

PCT Pub. Date: Dec. 12, 1991

[30] Foreign Application Priority Data

May 25, 1990 [GB] United Kingdom ..... 9011721

[51] Int. Cl.[5] ..... B67D 5/46

[52] U.S. Cl. ..... 222/391

[58] Field of Search ..... 222/326, 327, 391, 383

[56] References Cited

U.S. PATENT DOCUMENTS

| | | | |
|---|---|---|---|
| 2,720,345 | 10/1955 | Slobin | 222/326 |
| 2,877,935 | 3/1959 | Sherbondy | 222/326 |
| 3,311,265 | 3/1967 | Cyeighton, Jr. et al. | 222/391 X |
| 4,072,254 | 2/1978 | Cox | 222/391 |
| 4,382,530 | 5/1983 | Calisto | 222/326 X |
| 4,813,574 | 3/1989 | Hwan | 222/391 X |
| 4,815,663 | 3/1989 | Tada | 222/383 X |
| 5,156,305 | 10/1992 | Eyre | 222/327 |

FOREIGN PATENT DOCUMENTS

| | | | |
|---|---|---|---|
| 641736 | 3/1984 | Switzerland . | |
| 1555455 | 11/1979 | United Kingdom | 222/391 |

*Primary Examiner*—Andres Kashnikow
*Assistant Examiner*—Kenneth Bomberg
*Attorney, Agent, or Firm*—Edwin D. Schindler

[57] ABSTRACT

A sealant gun 1 comprises:

two resilient longitudinally extending support arms 2, 3 connecting a stock 4 and an apertured end portion 5 having a rectangular cross section;

a handle 13 projecting from stock 4;

a trigger 11 mounted in the stock 4 and arranged to incrementally drive a push plate 9 attached to a push rod 10 (which together form a piston) in the longitudinal direction passing through stock 4; and catch plate 15 and spring 16 arranged to selectively prevent or enable the piston to be retracted in the longitudinal direction.

7 Claims, 2 Drawing Sheets

SEALANT GUN

This invention relates to sealant guns; that is dispensing guns for dispensing viscous sealants from cartridges containing such sealants.

Sealant guns for dispensing sealant from cartridges (which are generally cylindrical) are well known. Such a dispensing gun is disclosed for example in British patent specification 1555455. Such sealant guns are generally largely of metal construction, although more recently, moulded plastics sealant guns have been developed. The mechanical construction of such sealant guns is quite complex, requiring rivets and the like to be used during assembly. Furthermore, point of sale display of a number of such Suns is problematic since their annular end portions make it difficult or impossible to stack a series of sealant guns or hang them side by side on display racks.

According to a first aspect of the invention, there is provided a sealant gun which comprises:

(a) first and second spaced elongate members extending longitudinally between a stock portion and an apertured distal end portion;

(b) a longitudinally extending piston arranged to be movable through and guided by at least one longitudinally facing aperture in said stock portion;

(c) handle means projecting from said stock portion;

(d) a trigger member having a shaped cam end arranged to actuate a drive member into engagement with said piston, said trigger means being provided with integral formations on opposed inwardly facing portions arranged to cooperatively engage with complementary shaped pivot formations provided integrally on transversely opposed portions of said stock portion, such that said trigger member is pivotally movable relative to said stock portion between a first position, in which said trigger member is angularly spaced from said handle means, and a second position, in which said trigger member lies adjacent said handle means along complementary lengths thereof;

(e) resilient biasing means arranged to engage, proximate one end thereof, with a part of said stock portion, and, proximate the other end thereof, with said drive member, such that said drive member is biased against said shaped cam end of said trigger member; and (f) releasable locking means arranged to selectively prevent or enable the piston to be retracted in the longitudinal direction of the gun.

It is preferred that at least the elongate members, stock portion, distal portion and handle means are integrally moulded of a plastics material such as glass fibre reinforced polypropylene or tile like. It is further preferred that the trigger member is also of moulded plastics.

The pivot formations on the stock portion are preferably in the form of raised ribs on shoulders projecting outwardly from opposed faces of the stock portion. In this case, the trigger means is preferably provided with a slot, having opposed internal faces, in the region of the cam end, each of the opposed faces being provided with a recessed region arranged to receive a respective one of the ribs or shoulders provided on the opposed faces of the stock portion. Preferably, each of the recesses is generally triangular in shape with the apex of the triangle arranged to locate and engage with an end of a respective rib or shoulder such that the trigger member is pivotable relative to said stock portion. The sides of the triangular recesses serve to limit the range of movement of the trigger member relative to stock portion since they engage with the shoulders on the stock portion at the limits of pivotal movement of the trigger member.

According to a second aspect of the invention, there is provided a sealant gun which comprises:

(a) first and second spaced elongate members extending longitudinally between a stock portion and an apertured distal end portion, said distal end portion having a generally rectangular outer surface profile:

(b) handle means provided projecting from said stock portion:

(c) actuation means mounted in said stock portion arranged to incrementally drive a pin, ton in the longitudinal direction such that said piston passes through at least one guiding aperture in said stock portion; and (d) releasable locking means arranged to selectively prevent enable the piston to be retracted in the longitudinal direction.

Preferably at least the first and second elongate members, stock and end portions, and handle means ape integrally mouled of plastics, preferably by injection moulding of glass-fibre-reinforced polypropylene.

Advantageously, the aperture in the distal end portion is generally rectangular. It is preferred that the transverse width of the distal end portion is substantially equal to the transverse width of the first and second elongate members.

The invention will now be further described in a particular embodiment, by way of example only, with reference to the accompanying drawings in which:

FIG. 1 is a schematic side view of a sealant gun in accordance with the invention:

FIG. 2*a* is a sectional view along A—A line of the gun of FIG. 1;

FIG. 2*b* is a sectional view along B—B line of the gun of FIG. 1;

Figure 1:
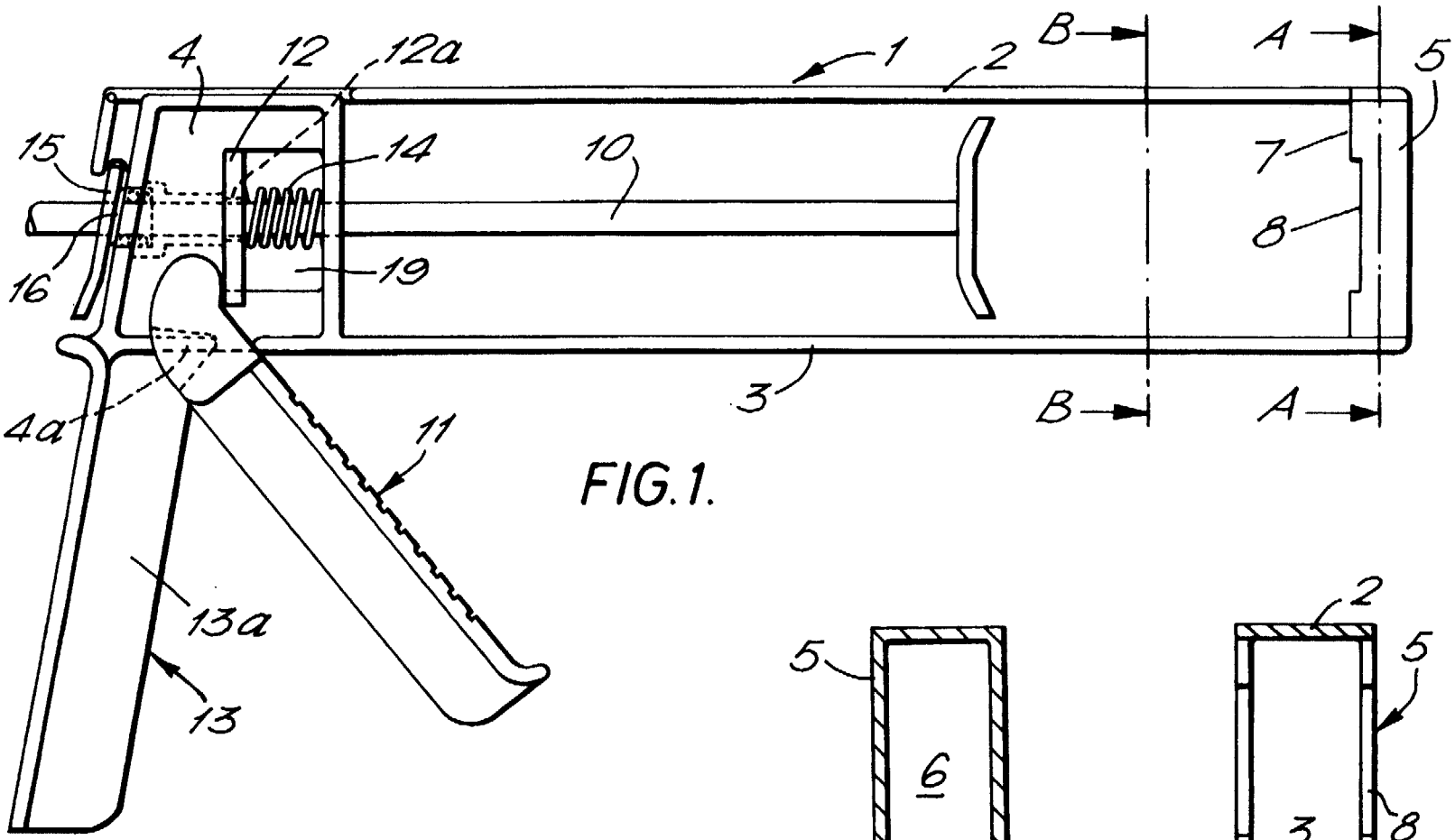
Figure 2B:
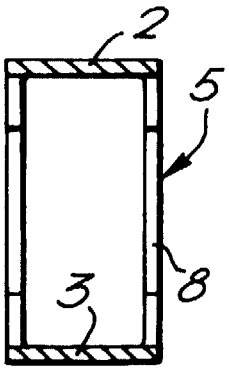
Figure 2A:
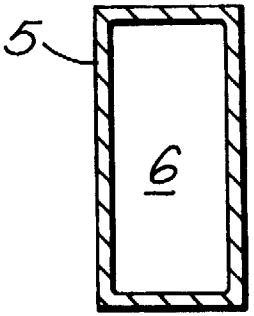

Referring to the drawings, the sealant gun generally designated 1, has two resilient longitudinally extending support arms 2, 3 connecting a stock 4 with an end portion 5. As can be seen from FIG. 2, the end portion 5 is rectangular in transverse cross-section having a rectangular aperture 6 therethrough. In use, a cylindrical mastic sealant cartridge of standard type is supported between the resilient support arms 2, 3 with the nozzle of the cartridge protruding through the aperture 6. An annular face of the forward end of the cartridge will abut the edges 7 of the end portion 5, a recess 8 being provided to accommodate a raised portion generally present on the forward face of such cartridges. A push plate 9 attached to push rod 10 (which together form a piston) moves internally incrementally along the length of the cartridge, when the trigger mechanism of the gun is actuated by means of trigger 11, forcing the sealant out of the nozzle in the conventional manner.

Figures 3, 4, 5, 6:
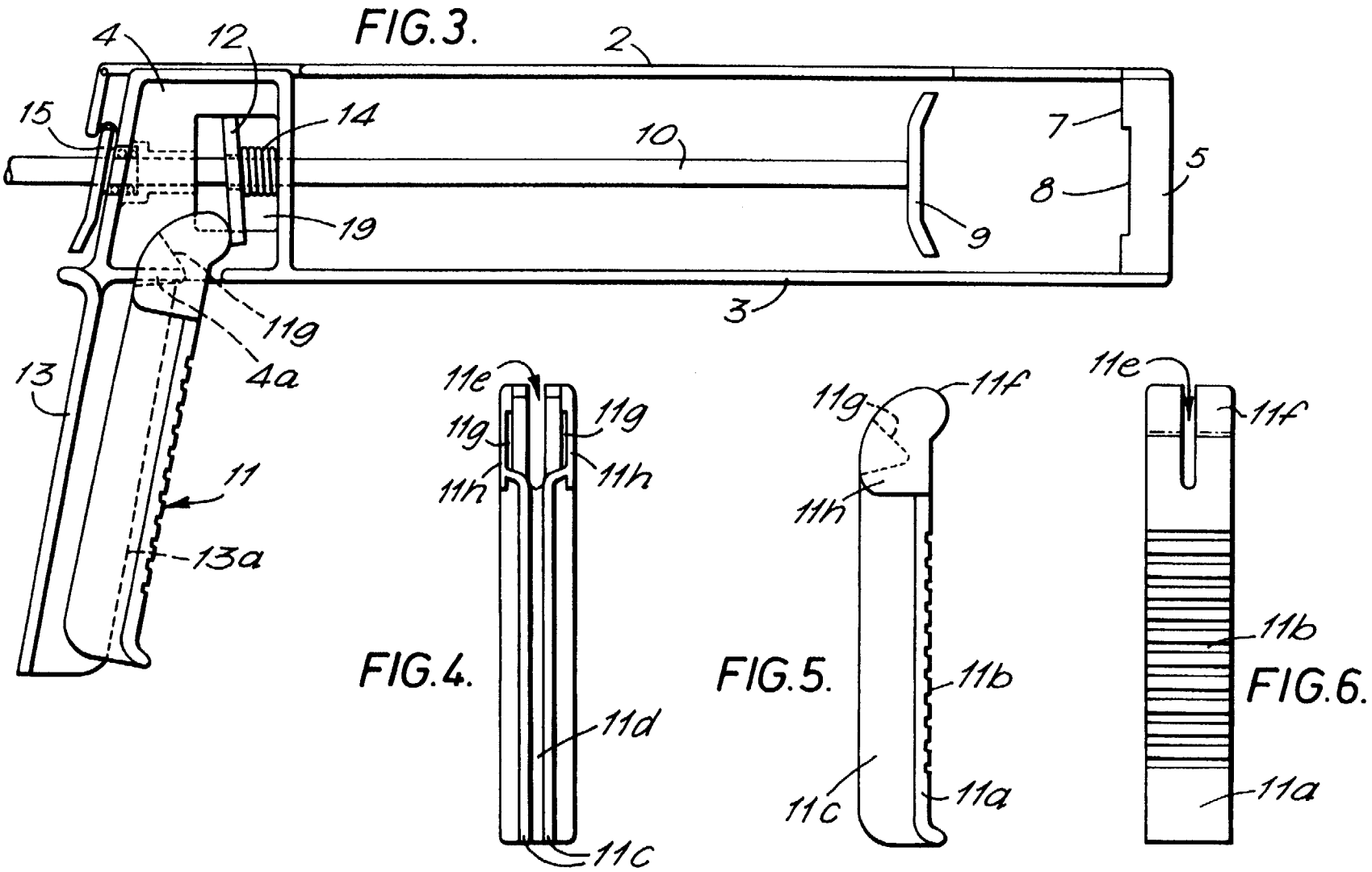
FIG. 3 is a schematic side view of the gun of FIG. 1 in a different state of actuation.
FIG. 4 is a rear elevation of the trigger member of FIGS. 1 and 3.
FIG. 5 is a side elevation of the trigger member of FIG. 4.
FIG. 6 is a front elevation of the trigger member of FIGS. 4 and 5.

The trigger mechanism comprises trigger 11, drive plate 12, handle 13 and spring 14, which co-operate with the stock 4. The trigger 11 which is best seen in FIGS. 4 to 6 is of a moulded plastics material, having a longitudinally extending face 11*a* provided with gripping ribs 11*b*. On the reverse face and perpendicular thereto are two longitudinally extending rib projections 11*c* which defne a channel 11*d*. At one end, the trigger has a notch 11*e* which is of a suitable width to locate around the lowermost portion of the stock 4. A cam projection 11*f* is provided at this end of the trigger and in use slidingly engages with a face of the drive plate 12. Generally triangularly shaped recesses 11*g* are provided on internal faces of sidewalls 11*h* in the region of the adjacent the notch 11*e*, and these in use co-operate with shoulders 4*a* projecting laterally from the face of the stock 4 at its lowermost edge. The notch 11*e* enables the trigger 11 to be located in position on the stock 4 with the recesses 11*g* being pivotally movable over a limited range (defined by the shape and size of the recesses) on the shoulders 4*a* of the stock 4. The recesses 11*g* are biased into contact with the shoulders 4*a* by means of the spring 14 and gripper plate 12, which has a notch on its lowermost edge which engages slidingly with opposed faces of the stock 4 when the plate 12 moves in the aperture 19. In this way assembly of the trigger mechanism is possible without the need for external riveting or fixing of a pivot post through the trigger and stock as in conventional sealant gun assemblies. Furthermore, the line of action of the trigger relative to the handle 13 is maintained consistent since rib 13*a* provided on the handle locates snugly in the channel 11*d* provided on the 11 when the handle pivots toward the trigger. This ensures that there is no transverse "wobbling" of the trigger 11 relative to the handle 13 during actuation.

In other respects, the actuation mechanism of the gun is similar to known sealant guns, the incremental movement the push rod 10 and push plate 11 being due to the fact that the aperture 12*a* in the gripper plate 12 "bites" into the push rod when the trigger 11 is pivoted towards the handle 13, pulling the rod 10 forward, and slides over the rod (due to a clearance fit of the rod 10 in the aperture 12*a*) when the trigger 11 pivots away from the handle 13. To retract the push rod 10 (for example once the sealant cartridge is empty), the catch plate 15 which is normally biased into its locking position by spring 16 is depressed and the rod 10 pulled back by means of a knob (not shown) provided on the end thereof.

The main body of the sealant gun (stock 4, handle 13, support arms 2, 3 and rectangular end portion 5) are typically formed as an integral unit by injection moulding; a suitable material for such an integral unit is glass fibre reinforced polypropylene. The handle is also generally formed by injection moulding of the same material.

As explained above, the gun has advantages in terms of cost of production (since no trigger pivot posts or rivets are required) and ease of assembly. A further significant advantage over existing designs of sealant gun is provided by the reactangular cross-section of the end portion 5, since such a cross-section enables a number of such sealant guns to be conveniently and easily stacked or suspended, side by side, on display hooks. This is not possible with conventional designs where a circular cross-sectioned end portion results in a coning effect with the increased transverse dimension at this end of the gun.

I claim:

1. A sealant gun which comprises:

(a) first and second spaced elongate members extending longitudinally between a stock portion and an apertured distal end portion;

(b) a longitudinally extending piston arranged to be movable through and guided by at least one longitudinally facing aperture in said stock portion;

(c) handle means projecting from said stock portion;

(d) a trigger member having a shaped cam end arranged to actuate a drive member into engagement with said piston, said trigger member being provided with integral generally triangular recesses on opposed inwardly facings portions, said generally triangular recesses having apexes arranged to cooperatively engage with respective shoulders provided integrally on transversely opposed portions of said stock portion, such that said trigger member is pivotally movable relative to said stock portion between a first position, in which said trigger member is angularly spaced from said handle means, and a second position, in which said trigger means lies adjacent said handle means along complementary lengths thereof;

(e) resilient biassing means arranged to engage, proximate one end thereof, with a part of said stock portion, and, proximate the other end thereof, with said drive member, such that said drive member is biased against said shaped cam end of said trigger member; and (f) releasable locking means arranged to selectively prevent or enable the piston to retracted in the longitudinal direction of the gun.

2. A sealant gun according to claim 1, wherein said trigger member is provided with a slot, having opposed internal faces, in the region of said cam end, each of said opposed faces being provided with a respective said generally triangular recess.

3. A sealant gun according to claim 1, wherein said elongate members, stock portion, distal portion and handle means are integrally molded of a plastics material.

4. A sealant gun according to claim 3, wherein said trigger member is integrally molded of a plastic material.

5. A sealant gun according to claim 3, wherein said plastics material comprises glass fibre reinforced polypropylene.

6. A sealant gun according to claim 1, wherein said aperture in the distal end portion is generally rectangular.

7. A sealant gun according to claim 6, wherein the transverse width of the distal end portion is substantially equal to the transverse width of the first and second elongate members.

* * * * *